US008277711B2

(12) United States Patent
Huang et al.

(10) Patent No.: US 8,277,711 B2
(45) **Date of Patent: *Oct. 2, 2012**

(54) PRODUCTION OF NANOFIBERS BY MELT SPINNING

(75) Inventors: Tao Huang, Downingtown, PA (US); Larry R. Marshall, Chesterfield, VA (US); Jack Eugene Armantrout, Richmond, VA (US); Scott Yembrick, Wilmington, DE (US); William H. Dunn, Wilmington, DE (US); James M. Oconnor, Claymont, DE (US); Tim Mueller, Wilmington, DE (US); Marios Avgousti, Kennett Square, PA (US); Mark David Wetzel, Newark, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 169 days.

This patent is subject to a terminal disclaimer.

(21) Appl. No.: 12/077,355

(22) Filed: Mar. 18, 2008

(65) Prior Publication Data

US 2008/0242171 A1 Oct. 2, 2008

Related U.S. Application Data

(60) Provisional application No. 60/921,135, filed on Mar. 29, 2007.

(51) Int. Cl.
*B29C 47/00* (2006.01)

(52) U.S. Cl. ..... 264/211.1; 977/900; 977/762

(58) Field of Classification Search ..... None
See application file for complete search history.

(56) References Cited

U.S. PATENT DOCUMENTS

| | | | | |
|---|---|---|---|---|
| 2,433,000 | A | | 12/1947 | Manning |
| 2,587,710 | A | | 3/1952 | Downey |
| 2,609,566 | A | * | 9/1952 | Slayter et al. ..... 65/460 |
| 3,097,085 | A | | 7/1963 | Wallsten |
| 3,231,639 | A | | 1/1966 | Mabru |
| 3,475,198 | A | | 10/1969 | Drum |
| 4,277,436 | A | * | 7/1981 | Shah et al. ..... 264/518 |
| 4,323,524 | A | * | 4/1982 | Snowden ..... 264/8 |
| 4,348,341 | A | * | 9/1982 | Furuya et al. ..... 264/8 |
| 4,536,361 | A | | 8/1985 | Torobin |
| 4,937,020 | A | | 6/1990 | Wagner et al. |
| 5,807,436 | A | | 9/1998 | Stachelhaus et al. |
| 6,183,670 | B1 | | 2/2001 | Torobin |
| 6,315,806 | B1 | | 11/2001 | Torobin et al. |

(Continued)

FOREIGN PATENT DOCUMENTS

CN 14723732 3/2003

(Continued)

OTHER PUBLICATIONS

PCT International Search Report and Written Opinion for International Application No. PCT/US2008/004081 dated Mar. 27, 2008.

(Continued)

*Primary Examiner* — Christina Johnson
*Assistant Examiner* — Benjamin Schiffman

(57) ABSTRACT

A process and apparatus for forming nanofibers from a spinning melt utilizing a high speed rotating distribution disc. The fibers can be collected into a uniform web for selective barrier end uses. Fibers with an average fiber diameter of less that 1,000 nm can be produced.

16 Claims, 12 Drawing Sheets

U.S. PATENT DOCUMENTS

| | | | | |
|---|---|---|---|---|
| 6,524,514 | B1 | 2/2003 | Volokitin et al. | |
| 6,752,609 | B2 | 6/2004 | Volokitin et al. | |
| 7,326,043 | B2 | 2/2008 | Joo et al. | |
| 2002/0089094 | A1 * | 7/2002 | Kleinmeyer et al. | 264/465 |
| 2006/0012084 | A1 * | 1/2006 | Armantrout et al. | 264/465 |
| 2007/0202769 | A1 | 8/2007 | Groner et al. | |
| 2008/0023888 | A1 | 1/2008 | Brang et al. | |
| 2009/0102100 | A1 | 4/2009 | Hellring et al. | |
| 2009/0160099 | A1 * | 6/2009 | Huang | 264/465 |

FOREIGN PATENT DOCUMENTS

| | | |
|---|---|---|
| EP | 1999304 | 12/2010 |
| JP | 49-110910 | 10/1974 |
| JP | 58-104212 | 6/1983 |
| WO | WO 2005/100654 | 10/2005 |
| WO | WO2007/110783 | 10/2007 |

OTHER PUBLICATIONS

Ward G F:"Meltdown nanofibers for nanowoven filtration applications",Filtration and Separation,Elsevier Advanced Technology,Oxford,GB,vol. 38, No. 9, Nov. 1, 2001 p. 42-43.

N. Dombrowksi and R.L. Lloyd, Atomisation of Liquids by Spinning Cups, The Chemical Engineering Journal, 1974, 63-81, Journal 8, Elsevier Sequiois, S.A., Lausanne.

Martin Dauner, "Nanofibers for Filtration and Separation", 3rd international symposium, "How to Enter Technical Textiles Markets 3", Ghent, Belgium, Nov. 17-18, 2005.

International Newsletter Ltd., the 3rd international symposium How to Enter Technical Textiles Markets 3 Brochure and Registration Form and list of participants scheduled for Nov. 17-18, 2005 at Ghent, Belgium.

Martin Dauner, "Fortschritte in der Nanofaser-Erzeugung", 20. Hofer Vliesstoffage 2005, Hof, Germany, Nov. 9-10, 2005.

Internet posting at http://www.hofer-vliesstofftage.de/vortrag-2005.php of presentations for 20. Hofer Vliesstoffage 2005, see link to item 02; Program Schedule for 20. Hofer Vliesstoffage 2005 at Hof, Germany, Nov. 9-10, 2005.

Martin Dauner, "Centrifuge Spinning—a new technology to improve polymeric filter media", 8. Symposium Textile Filter, Chemnitz, Germany, Mar. 7-8, 2006 (slides and paper).

Listing of Abstracts and Topics for 8. Symposium Textile Filter, Chemnitz, Germany, Mar. 7-8, 2006.

Purchase Order from Bollig & Kemper GmbH Co. KG to Reiter GmbH Co. KG for Hochrotationsspruhsystems CENTERBELL dated Aug. 15, 2005; and Delivery Note from Reiter GmbH Co. KG to Bollig & Kemper for Hochrotationsspruhsystems dated Sep. 21, 2005.

Reiter GmbH Co. KG, Operating Manual for "Hochrotationssystem HR Center Bell mit Glockenhaube", pp. 1-6, Aug. 2002.

ITWRansburg, Service manual LN-9264-08 for AerobellTM, pp. 1, 35, and 51, Oct. 2008.

Translated (from German to English) portions of Opposition Brief filed on Sep. 29, 2011 by Reiter GmbH + Co. KG Oberflachentechnik opposing European Patent EP 1 999 304 B1.

* cited by examiner

PRODUCTION OF NANOFIBERS BY MELT SPINNING

BACKGROUND OF THE INVENTION

1. Field of the Invention

This invention relates to a melt spinning process for forming fibers and fibrous webs. In particular, very fine fibers can be made and collected into a fibrous web useful for selective barrier end uses such as in the fields of air and liquid filtration, flame retardancy, biomedical, battery and capacitor separators, biofuel membranes, cosmetic facial masks, biomedical applications, such as, hemostasis, wound dressings and healing, vascular grafts, tissue scaffolds, synthetic ECM (extra cellular matrix), and sensing applications, electronic/optical textiles, EMI Shielding, and antichembio protective coatings.

2. Background

Centrifugal atomization processes are known in the art for making metal, metal alloy and ceramics powers. Centrifugal spinning processes are known in the art for making polymer fibers, carbon pitch fibers and glass fibers, such as disclosed in U.S. Pat. Nos. 3,097,085 and 2,587,710. In such processes, the centrifugal force supplied by a rotational disc or distribution disc produces enough shear to cause the material to become atomized or to form fibers. However, centrifugal spinning has only been successfully used for the production of fibers with diameters larger than micron size.

There is a growing need for very fine fibers and fibrous webs made from very fine fibers. These types of webs are useful for selective barrier end uses. Presently very fine fibers are made from melt spun "islands in the sea" cross section fibers, split films, some meltblown processes, and electrospinning. However, these processes are generally limited to making non-commercial quantities of nanofibers because of their very low throughput.

In order to successfully produce nano or sub-micrometer diameter fibers by melt-spinning, drawing of the polymer must occur as a result of either mechanical or electrostatic forces acting on the melt jet at the spinneret. However, it is very difficult to generate the forces needed to create a reduction in diameter to the nanometer level. Melt-electrospinning has been conducted in some universities since the later 1970s, but there was no success reported in making nanofibers, especially from polyolefins, such as polyethylene (E) and polypropylene (PP).

Electrospinning and electroblowing are processes for forming fibers with sub-micron scale diameters from polymer solutions through the action of electrostatic forces and/or shear force. The fibers collected as non-woven mats have some useful properties such as high surface area-to-mass ratio, and thus have great potential in filtration, biomedical applications (such as, wound dressings, vascular grafts, tissue scaffolds), and sensing applications.

However, a vast majority of nanofibrous structures are produced by solvent based spinning processes. Chemicals used as solvents to dissolve many of the polymers being spun may leave residuals that are not compatible within the industry. With the intent of cleaner processing, environmental safety, and productivity, there is a persistent desire to produce fibers by melt spinning.

Spinning nanofibers directly from polymer melts would offer several advantages over solution based spinning: elimination of solvents and their concomitant recycling requirements, higher throughput, and spinning of polymers with low solvent solubility. Likewise, multi-component systems such as blends and composites would be more readily melt spun, because in many cases there is no common solvent for such blends. Finally, productivity would increase 10-500 fold and costs would drop significantly due to elimination of solvent recovery.

What is needed is a high throughput, cost effective and energy efficient process to melt spin nanofiber fibers and uniform fibrous webs.

SUMMARY OF THE INVENTION

In one embodiment, the present invention is directed to a nanofiber forming process comprising the steps of supplying a spinning melt of at least one thermoplastic polymer to an inner spinning surface of a heated rotating distribution disc having a forward surface fiber discharge edge, issuing the spinning melt along said inner spinning surface so as to distribute the spinning melt into a thin film and toward the forward surface fiber discharge edge, and discharging separate molten polymer fibrous streams from the forward surface discharge edge to attenuate the fibrous streams to produce polymeric nanofibers that have mean fiber diameters of less than about 1,000 nm.

A second embodiment of the present invention is a melt spinning apparatus for making polymeric nanofibers, comprising a molten polymer supply tube having an inlet portion and an outlet portion and at least one molten polymer outlet nozzle at the outlet portion thereof, said supply tube positioned axially through said melt spinning apparatus, a spinneret comprising a rotatable molten polymer distribution disc, having an inner spinning surface inlet portion surrounding and in fluid communication with said outlet portion of said molten polymer supply tube, and an indirect heating source directed at said rotatable molten polymer distribution disc.

Another embodiment of the present invention is a collection of nanofibers comprising polyolefin, having mean fiber diameters of less than about 500 nm.

DETAILED DESCRIPTION OF THE INVENTION

Figure 1:
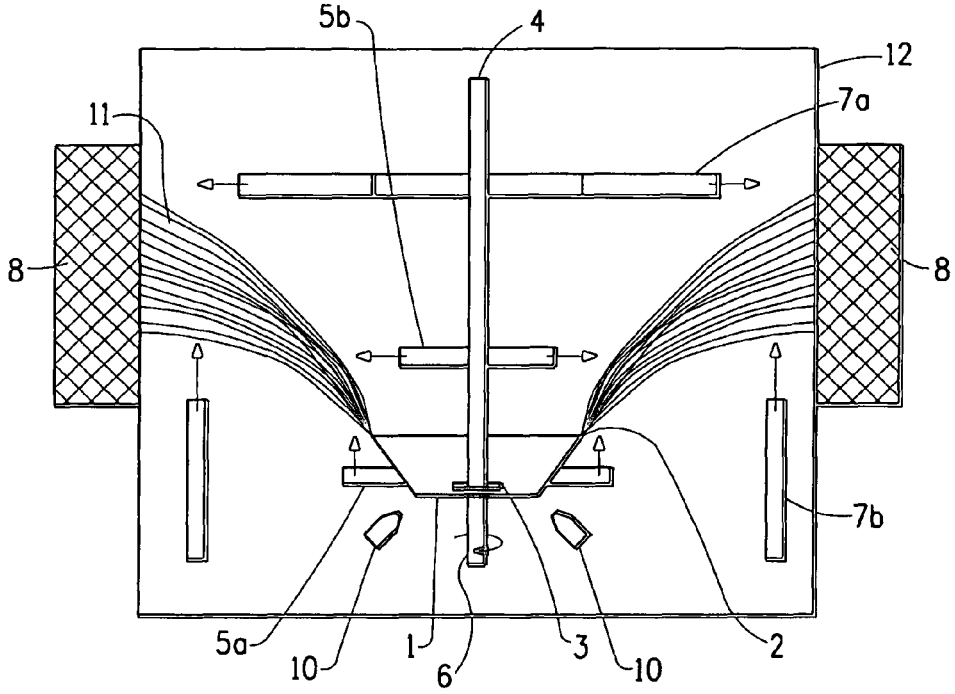
FIG. 1 is a cut-away cross-sectional view of a melt spinning apparatus suitable for use in forming melt spun nanofibers according to the present invention.

In classical centrifugal fiber spinning processes, there are two types of spinnerets. Capillary-based spinning uses a rotor with side nozzle holes. A polymer melt is pushed out through the side nozzle holes, and large diameter fibers are formed by centrifugal stretching, such as disclosed in U.S. Pat. No. 4,937,020. Capillary-based classical centrifugal spinning is not related to the case of the present invention. Another is film splitting-based spinning using a conical disc as rotor, such as disclosed in U.S. Pat. No. 2,433,000. A polymer melt or solution is issued either directly onto a conical disc surface, or through nozzle holes at the bottom of the distribution disc. Film splitting-based classical centrifugal spinning is more closely related to the present invention.

In the case of film splitting-based classical centrifugal spinning, large diameter fibers are formed from the splitting of a discrete thick melt film or non-uniform thick melt film with a thickness of about 3 to 4 mil. No nanofiber formation has been reported using this classical centrifugal fiber spinning process.

In contrast, according to the present invention, nanofibers are formed by film splitting at the forward discharge edge of a rotating distribution disc, such as a bell cup; from a fully spread thin melt film on the inner surface of the distribution disc, with a typical film thickness in the low micron range.

In the case of film splitting in classical centrifugal spinning, the polymer viscosity is relatively higher than in the case of the present invention. The higher the viscosity, the larger the fibers which are formed. In the present invention, if the polymer is of sufficiently low melt viscosity, the spinning melt can be spun into nanofibers without any rheology modification. Alternatively, in order to assist the spinning of a very high viscosity melt, the spinning polymer can be plasticized, hydrolyzed or otherwise cracked to lower the viscosity. Generally, a spinning melt with a viscosity between about 1,000 cP to about 100,000 cP is useful, even a viscosity between about 1,000 cP to about 50,000 cP.

In one alternative embodiment of the present invention, there is an additional stationary or "shear" disc placed downstream of the rotating distribution disc, and the polymer melt is issued through a gap between the rotating distribution disc and the shear disc, wherein the shear applied to the polymer melt causes shear thinning. The shear disc also acts as a melt distribution disc, helping to form a more uniform, fully spread, thin melt film on the inner surface of the rotating polymer distribution disc.

According to the present invention, the spinning melt comprises at least one polymer. Any melt spinnable, fiber-forming polymer can be used. Suitable polymers include thermoplastic materials comprising polyolefins, such as polyethylene polymers and copolymers, polypropylene polymers and copolymers; polyesters and co-polyesters, such as poly(ethylene terephthalate), biopolyesters, thermotropic liquid crystal polymers and PET coployesters; polyamides (nylons); polyaramids; polycarbonates; acrylics and meth-acrylics, such as poly(meth)acrylates; polystyrene-based polymers and copolymers; cellulose esters; thermoplastic cellulose; cellulosics; acrylonitrile-butadiene-styrene (ABS) resins; acetals; chlorinated polyethers; fluoropolymers, such as polychlorotrifluoroethylenes (CTFE), fluorinated-ethylene-propylene (FEP); and polyvinylidene fluoride (PVDF); vinyls; biodegradable polymers, bio-based polymers, bi-composite engineering polymers and blends; embedded nanocomposites; natural polymers; and combinations thereof.

FIG. 1 is an illustration of the cross-section view of the nanofiber melt spinning and web collection unit according to the present invention. A rotating spinneret contains a rotating distribution disc 1 suitable for forming fibers from the spinning melt. The distribution disc can have a concave or flat open inner spinning surface and is connected to a high speed motor (not shown) by a drive shaft 6. By "concave" we mean that the inner surface of the disc can be curved in cross-section, such as hemispherical, have the cross-section of an ellipse, a hyperbola, a parabola or can be frustoconical, or the like. The melt spinning unit can optionally include a stationary shear disc 3 mounted substantially parallel to the polymer distribution disc's inner surface. A spinning melt is issued along the distribution disc's inner surface, and optionally through a gap between the distribution disc inner surface and the shear disc, if present, so as to help distribute a sheared spinning polymer melt toward the forward surface of the discharge edge 2 of the distribution disc. The distribution disc and shear disc are heated by an indirect, non-contact heating device 10, such as an infrared source, induction heating device or other such radiational heating source, to a temperature at or above the melting point of the polymer. The spinning melt is pumped from an inlet portion of a supply tube 4, running axially through the shear disc 3, if present, toward the distribution disc 1 and exits the supply tube at an outlet portion thereof. The throughput rate of the melt can be between about 0.1 cc/min to about 200 cc/min, even between about 0.1 cc/min to about 500 cc/min.

As the spinning melt enters the gap between the distribution disc inner surface and stationary shear disc, it is directed into contact with the distribution disc inner surface, the polymer melt fully spreads and wets the distribution disc's inner surface, and a thin film of low micron-thickness forms and flows along the distribution disc's inner surface until it reaches the distribution disc's forward surface discharge edge 2. The rotational speed of distribution disc 1 is controlled to between about 1,000 rpm and about 100,000 rpm, even between about 5,000 rpm and about 100,000 rpm, or even between about 10,000 rpm and about 50,000 rpm. At the forward surface fiber discharge edge of the rotating distribution disc, the thin film splits into melt ligaments, the melt ligaments are further stretched by centrifugal force, and fibers 11 are produced from the ligaments stretching.

One or more hot gas (e.g. air or $N_2$) rings 5*a* and 5*b*, having hot gas nozzles disposed on the circumference thereof, can be positioned annular to the rotating distribution disc and/or the molten polymer supply tube, the nozzles being positioned so as to direct a hot gas flow toward the molten polymer ligaments, to maintain the temperature of the film splitting and ligament stretching regions above the melting point of the polymer, to maintain the ligaments in the melt state and enable further stretching into nanofibers. The hot gas flow can also act to guide the fibers toward the web collector 8.

Optionally, there can be one or more cooling gas (e.g. air or $N_2$) nozzles, 7*a* and 7*b*, or cooling gas rings having cooling gas nozzles disposed on the circumference thereof, positioned annular to the heating gas ring(s), to direct cooling gas flow into the fiber formation region to rapidly quench and solidify the nanofibers before they reach the web collector 8. The cooling gas flow further guides the nanofiber stream 11 toward the web collector 8.

Web collection can be enhanced by applying vacuum through the collector to pull the fibers onto the collector. The web collection ring 8 in FIG. 1 is a screen ring which is cooled, electrically grounded and connected to a blower (not shown) to form a vacuum collector ring. The web collector 8 can be cooled with flowing cold water or dry ice. A tubular web collecting screen 12 is positioned inside the web collection ring 8, and is moved vertically along the web collection ring 8 in order to form a uniform nanofibrous web. A nonwoven web or other such fibrous scrim can be situated on the tubular web collecting screen 12, onto which the nanofibers can be deposited.

Optionally, an electrostatic charge voltage potential can be applied and maintained in the spinning space between the distribution disc and the collector to improve the uniformity of the fibrous web laydown. The electrostatic charge can be applied by any known in the art high voltage charging device. The electrical leads from the charging device can be attached to the rotating spinneret and the collector, or if an electrode is disposed within the spinning space, to the spinneret and the electrode, or to the electrode and the collector. The voltage potential applied to the spinning unit can be in the range between about 1 kV and about 150 kV.

The designed temperature distribution surrounding the rotating distribution disc is an important distinguishing characteristic of the present invention process from classical centrifugal spinning.

Figure 2:
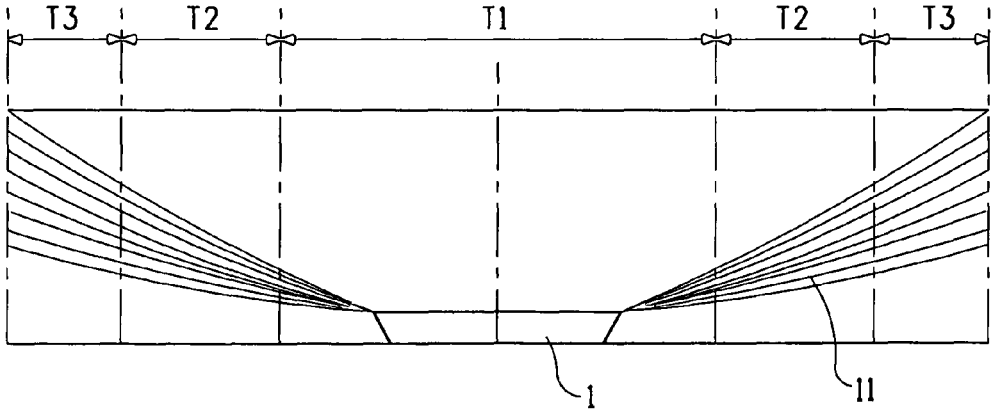
FIG. 2 is an illustration of the desired temperature profile within the fiber spinning and formation area of the melt spinning apparatus of the present invention.

FIG. 2 is an illustration of the designed temperature profile within the melt spinning region surrounding the rotational distribution disc 1, in which T1 is the temperature of melt spinning zone around the rotating distribution disc, T2 is the temperature of melt threads (ligaments) 11 stretching zone, and T3 is the temperature of rapid quenching and nanofiber solidifying zone, where T1>T2>Tm (the melting point of polymer) and T3<<Tm, i.e. well below the melting point of the polymer.

Figure 3A:
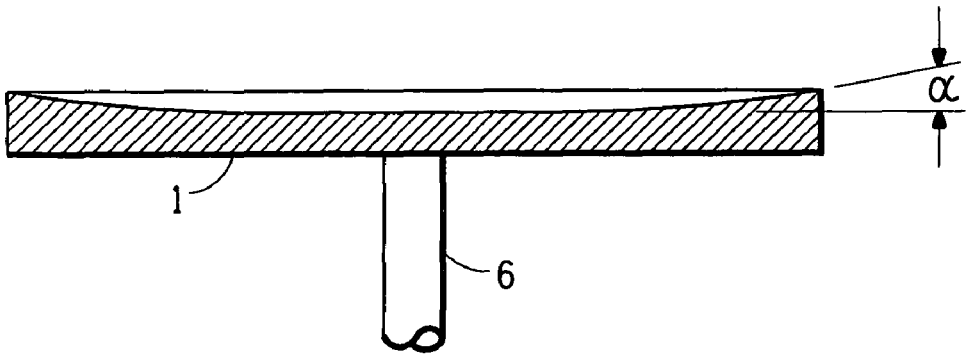
FIG. 3A is a cut-away side view, and 3B is a top view of a molten polymer distribution disc according to the present invention.
Figure 3B:
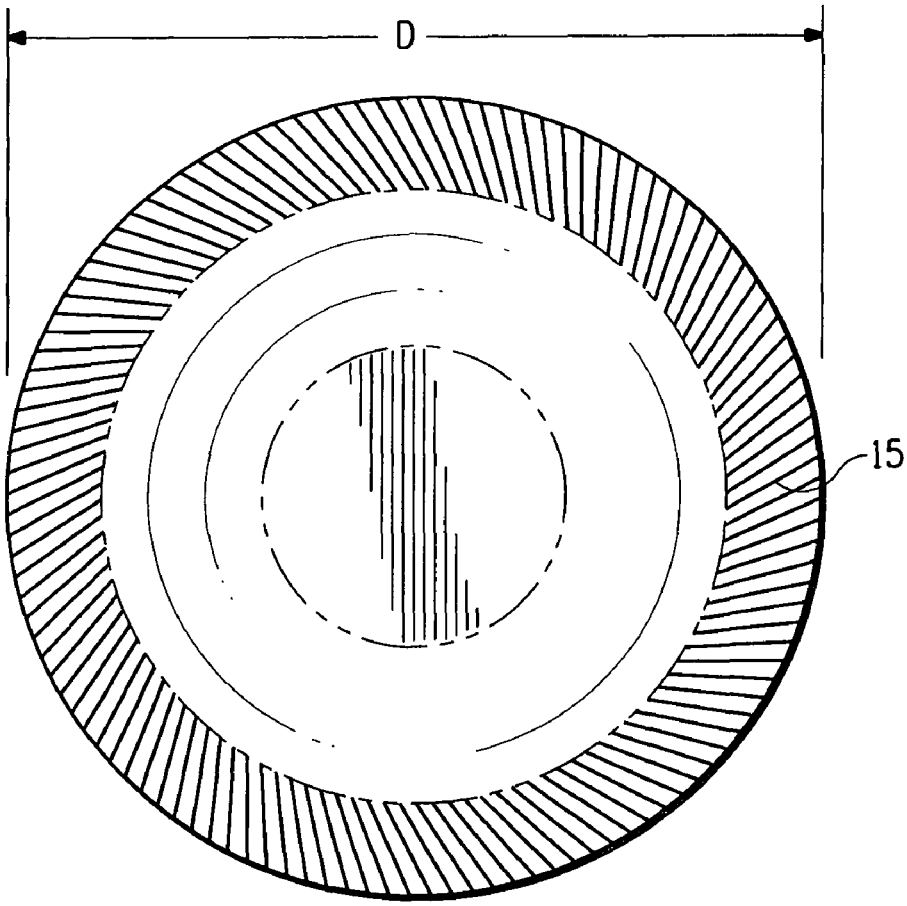

FIG. 3A is a side view and FIG. 3B is a top view of an example of a molten polymer distribution disc 1. The distribution disc geometry, especially the diameter D and angle $\alpha$ of the distribution disc, can influence the formation of fibers and fiber size. Diameter D of the present distribution disc is between about 10 mm and 200 mm, the angle $\alpha$ of the forward surface discharge edge is 0 degrees when the disc is flat, or between greater than 0 degrees to about 90 degrees, and the edge of the distribution disc is optionally serrated 15 in order to form the fully spread thin film on the inner surface of the distribution disc. The serration on the distribution disc edge also helps to form the more uniform nanofibers with relatively narrow fiber diameter distribution.

The present process can make very fine fibers, preferably continuous fibers, with a mean fiber diameter of less than about 1,000 nm and even between about 100 nm to about 500 nm. The fibers can be collected onto a fibrous web or scrim. The collector can be conductive for creating an electrical field between it and the rotary spinneret or an electrode disposed downstream of the spinneret. The collector can also be porous to allow the use of a vacuum device to pull the hot and/or cooling gases away from the fibers and help pin the fibers to the collector to make the fibrous web. A scrim material can be placed on the collector to collect the fiber directly onto the scrim thereby making a composite material. For example, a nonwoven web or other porous scrim material, such as a spunbond web, a melt blown web, a carded web or the like, can be placed on the collector and the fiber deposited onto the nonwoven web or scrim. In this way composite fabrics can be produced.

Surprisingly, the process and apparatus of the present invention have been demonstrated to successfully melt spin polyolefin nanofibers, in particular polypropylene and polyethylene nanofibers. The fiber size (diameter) distributions of said polyolefin nanofibers are believed to be significantly lower than heretofore known in the art polyolefin fibers. For example, U.S. Pat. No. 4,397,020 discloses a radial spinning process which, while suggesting the production of sub-micron polyolefin fibers having diameters as low as 0.1 micron, exemplifies only PP fibers having diameters of 1.1 micron. In contrast, according to the present invention, collections of polyolefin nanofibers having a mean fiber diameter of less than about 500 nm have been obtained, even less than or equal to about 400 nm, and the median of the fiber diameter distributions can be less than or equal to about 400 nm, or even less than 360 nm.

As can be seen from the Examples below, these low median fiber diameters demonstrate that in most cases the majority of polyolefin nanofibers collected are below the mean (number average) fiber diameters.

TEST METHODS

In the description above and in the non-limiting examples that follow, the following test methods were employed to determine various reported characteristics and properties.

Fiber Diameter was determined as follows. Ten scanning electron microscope (SEM) images at 5,000× magnification were taken of each nanofiber layer sample. The diameter of more than 200, or even more than 300 clearly distinguishable nanofibers were measured from the SEM images and recorded. Defects were not included (i.e., lumps of nanofibers, polymer drops, intersections of nanofibers). The average fiber diameter for each sample was calculated and reported in nanometers (nm).

EXAMPLES

Hereinafter the present invention will be described in more detail in the following examples.

Example 1

Continuous fibers were made using an apparatus as illustrated in FIG. 1, from an ultra-high melt flow rate polypropylene homopolymer, with a very narrow molecular weight distribution (Metocene MF650Y, from Basell USA Inc., density of 0.91 g/cc at 23° C. measured using ASTM D 792, MFR=1800 gram/10 min. measured using ASTM D1238). The typical shear viscosity of Metocene MF650Y PP is 4.89181 Pa-sec. at the shear rate of 10,000/sec. at 400° F. The melting point of Metocene MF650Y PP is Tm>160° C.

A PRISM extruder with a gear pump was used to deliver the polymer melt to the rotating spinneret through the supply tube. The pressure was set to a constant 61 psi. The gear pump speed was set to a constant set point 5 and this produced a melt feed rate of about 0.8 cc/min. The hot blowing air was set at a constant 30 psi. The rotating polymer melt distribution disc had a concave angle of 30 degrees, without a serrated discharge edge and in the absence of a shear disc. The rotation speed of the distribution disc was set to a constant 11,000 rpm. The temperature of the spinning melt from the melt supply tube was set to 251° C., the temperature of the distribution disc was set to 260° C. and the temperature of the blowing air was set to 220° C. No electrical field was used during this test.

Figure 4A:
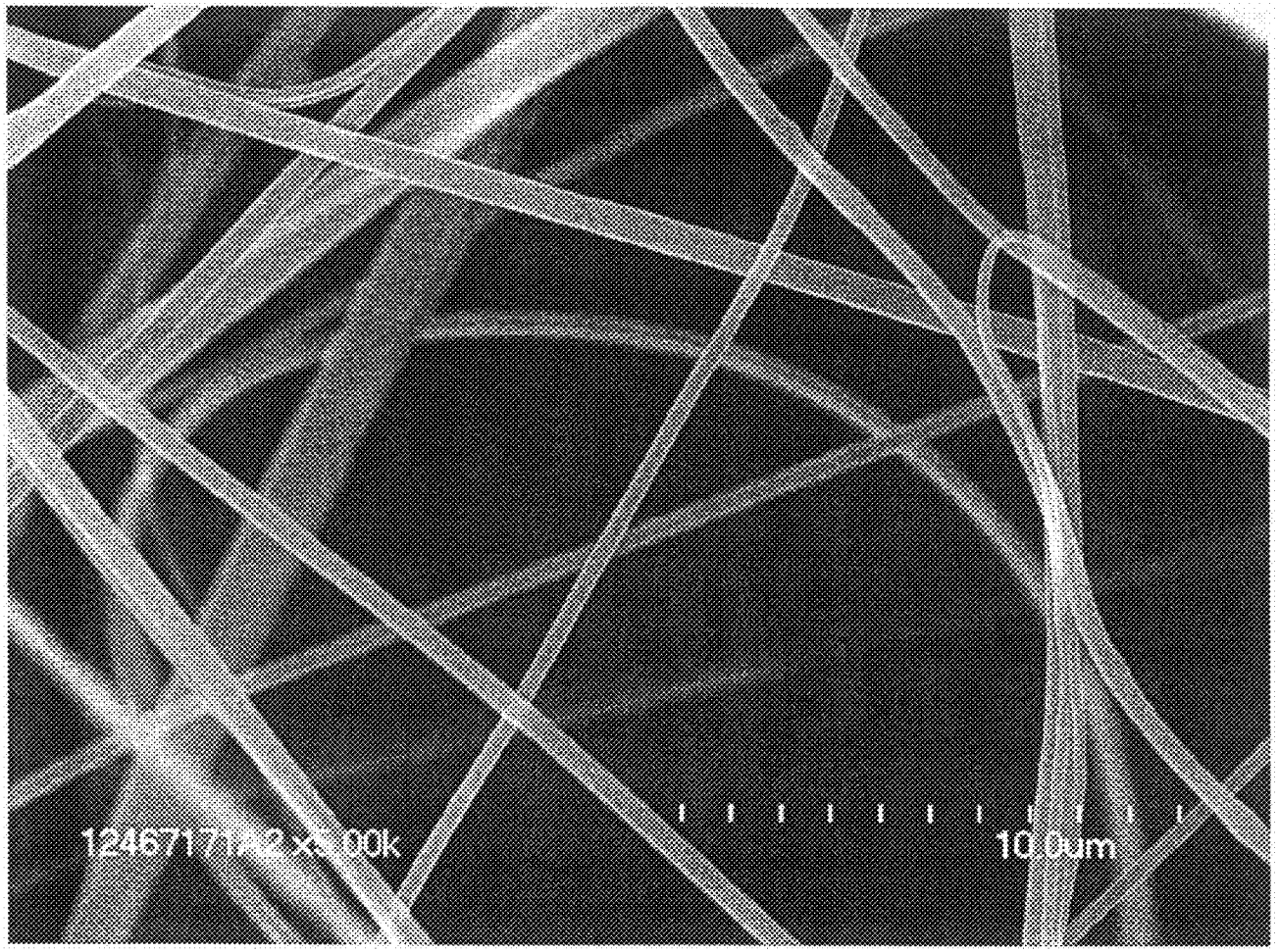
FIG. 4A is a scanning electron micrograph of polypropylene (PP) fibers from Example 1.
Figure 4B:
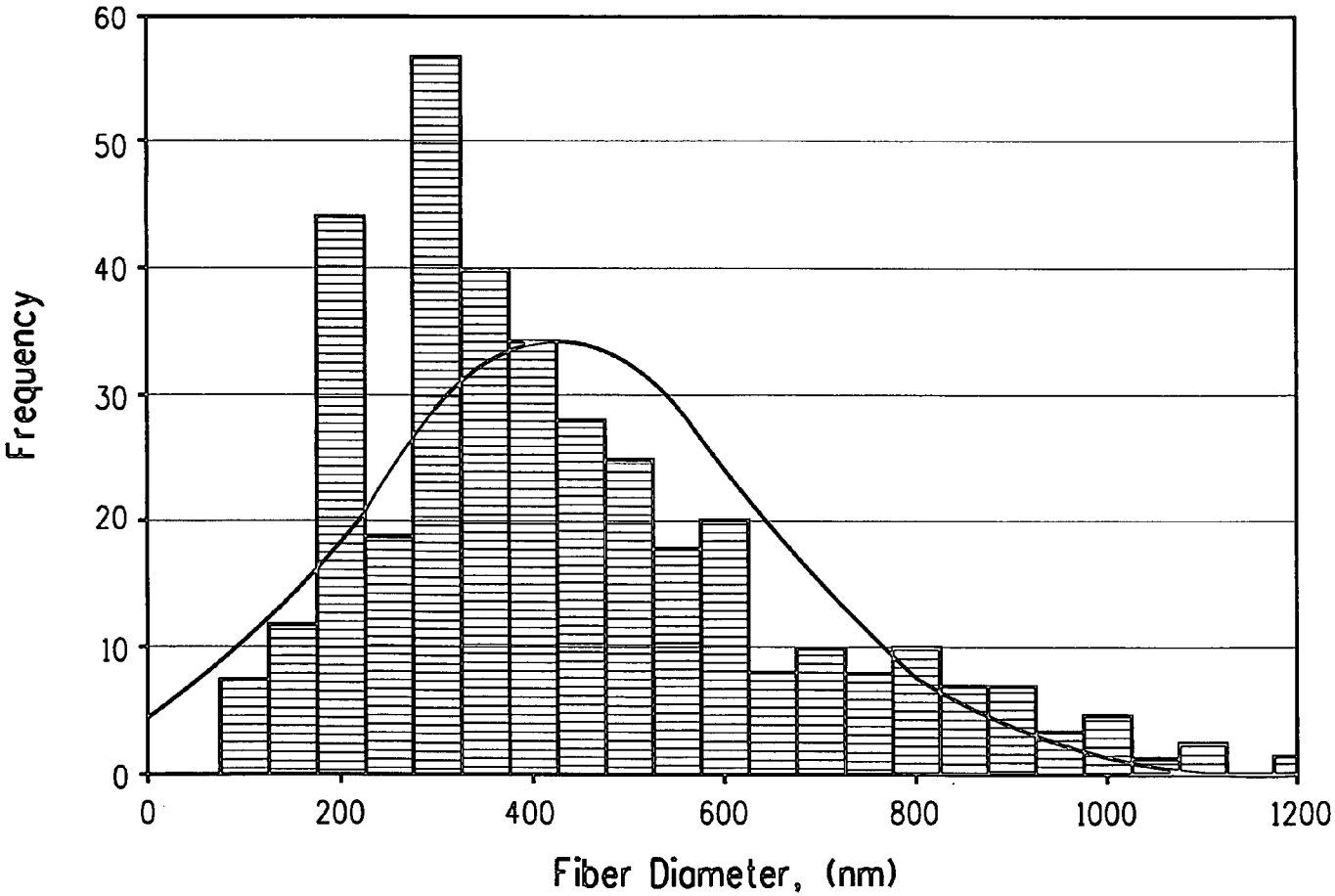
FIG. 4B is histogram of the fiber diameters of Example 1.

Nanofibers were collected on a Reemay nonwoven collection screen that was held in place 15 inches away from the distribution disc by stainless steel sheet metal. An SEM image of the fibers can be seen in FIG. 4A. The fiber size was measured from an image using scanning electron microscopy (SEM) and determined to be in the range of 99 nm to 1188 nm, with an average fiber diameter of about mean=430 nm and median=381 nm from the measurement of 366 fibers (FIG. 4B).

Example 2

Figure 5A:
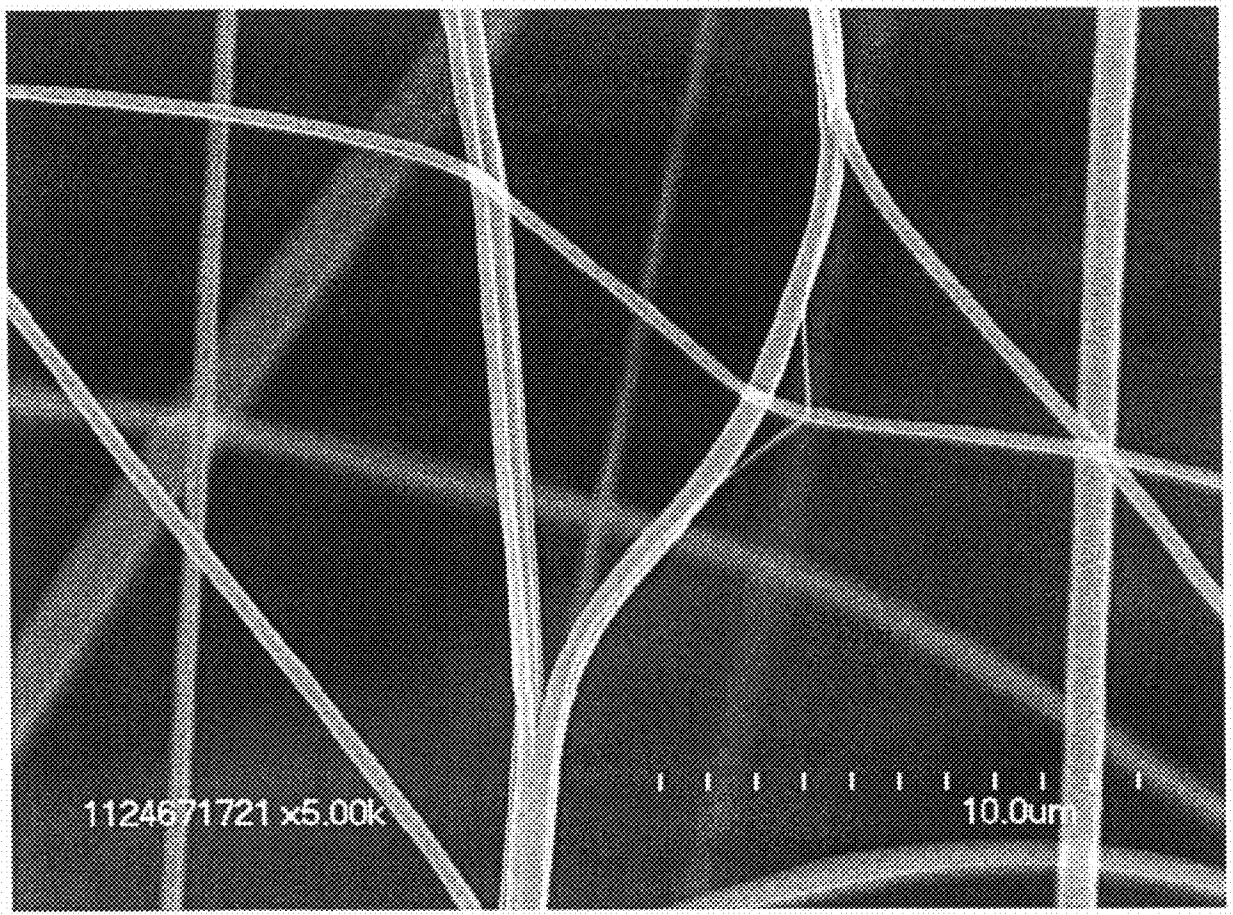
FIG. 5A is a scanning electron micrograph of polypropylene fibers from Example 2.
Figure 5B:
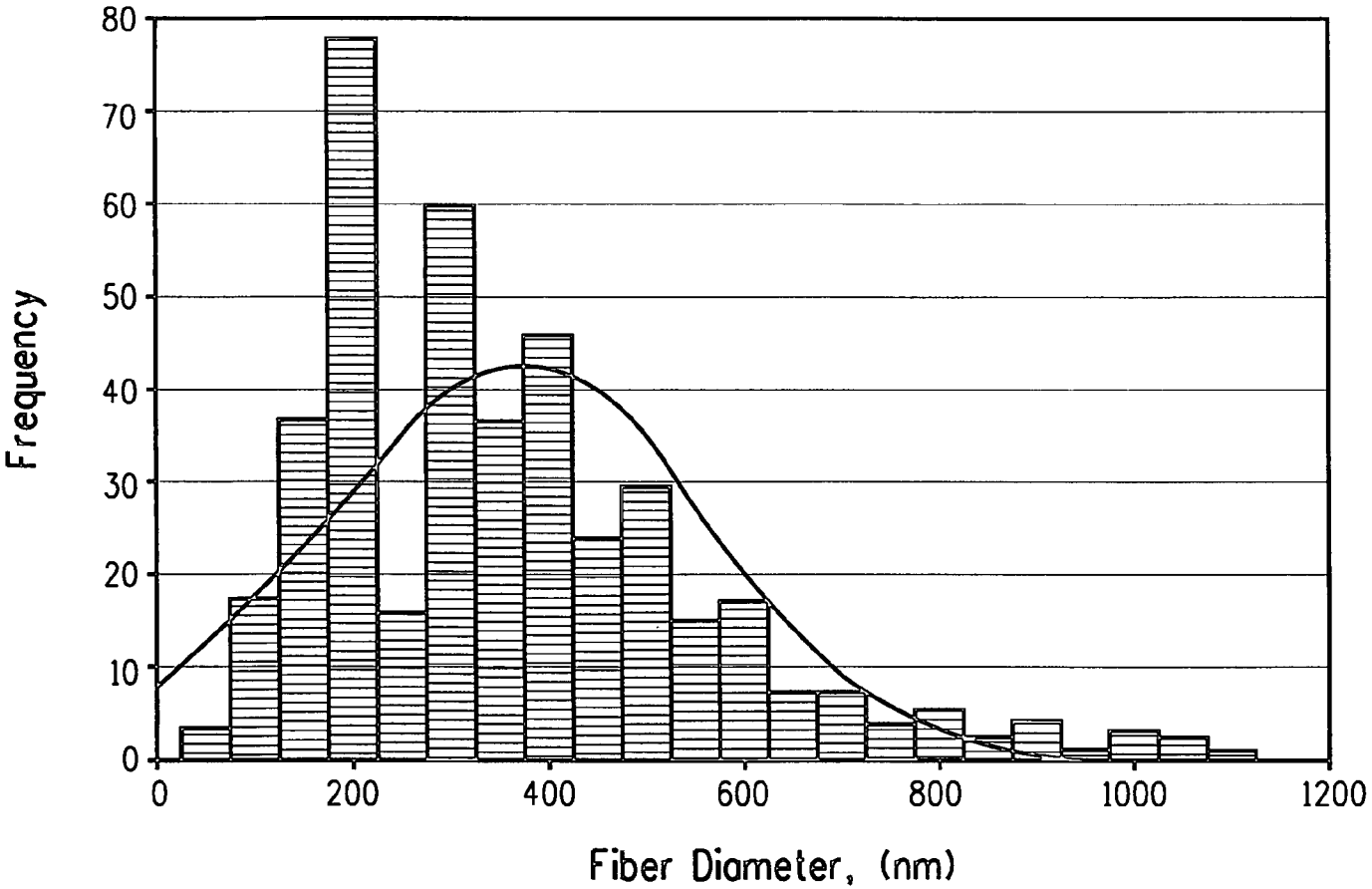
FIG. 5B is histogram of the fiber diameters of Example 2.

Example 2 was prepared similarly to Example 1, except the rotation speed of the distribution disc was set to a constant 13,630 rpm. The diameters of fibers became smaller than Example 1. An SEM image of the fibers can be seen in FIG. 5A. The fiber size was measured from an image using SEM and determined to be in the range of 40 nm to 1096 nm, with an average fiber diameter of about mean=363 nm and median=323 nm from the measurement of 422 fibers (FIG. 5B).

Example 3

Continuous fibers were made according to Example 1, except using a different PP homopolymer (Metocene MF650X, from Basell USA Inc., an ultra-high melt flow rate resin with very narrow molecular weight distribution, density of 0.91 g/cc at 23° C. measured using ASTM D 792, MFR=1200 gram/10 min. measured using ASTM D1238). The typical shear viscosity of Metocene MF650Y PP is 5.76843 Pa-sec. at the shear rate of 10,000/sec. at 400° F. The melting point of Metocene MF650Y PP is Tm>160° C.

The distribution disc had a concave angle of 15 degrees, without a serrated discharge edge and in the presence of a stationary shear disc. The rotation speed of the distribution disc was set to a constant 11,000 rpm. The temperature of the spinning melt from the melt supply tube was set to 251° C., the temperature of the distribution disc was set to 270° C. and the temperature of the blowing air was set to 220° C. No electrical field was used during this test.

Figure 6A:
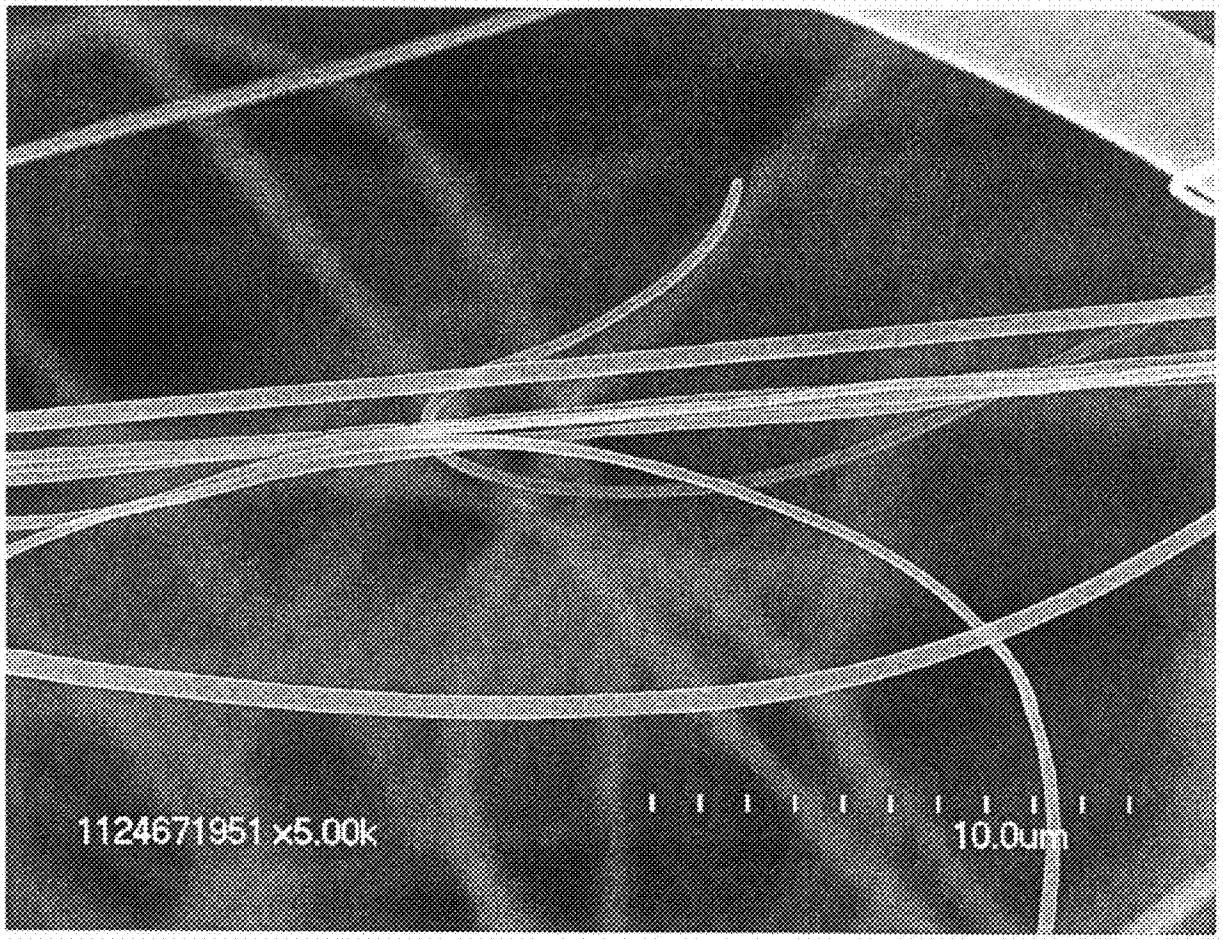
FIG. 6A is a scanning electron micrograph of polypropylene fibers from Example 3.
Figure 6B:
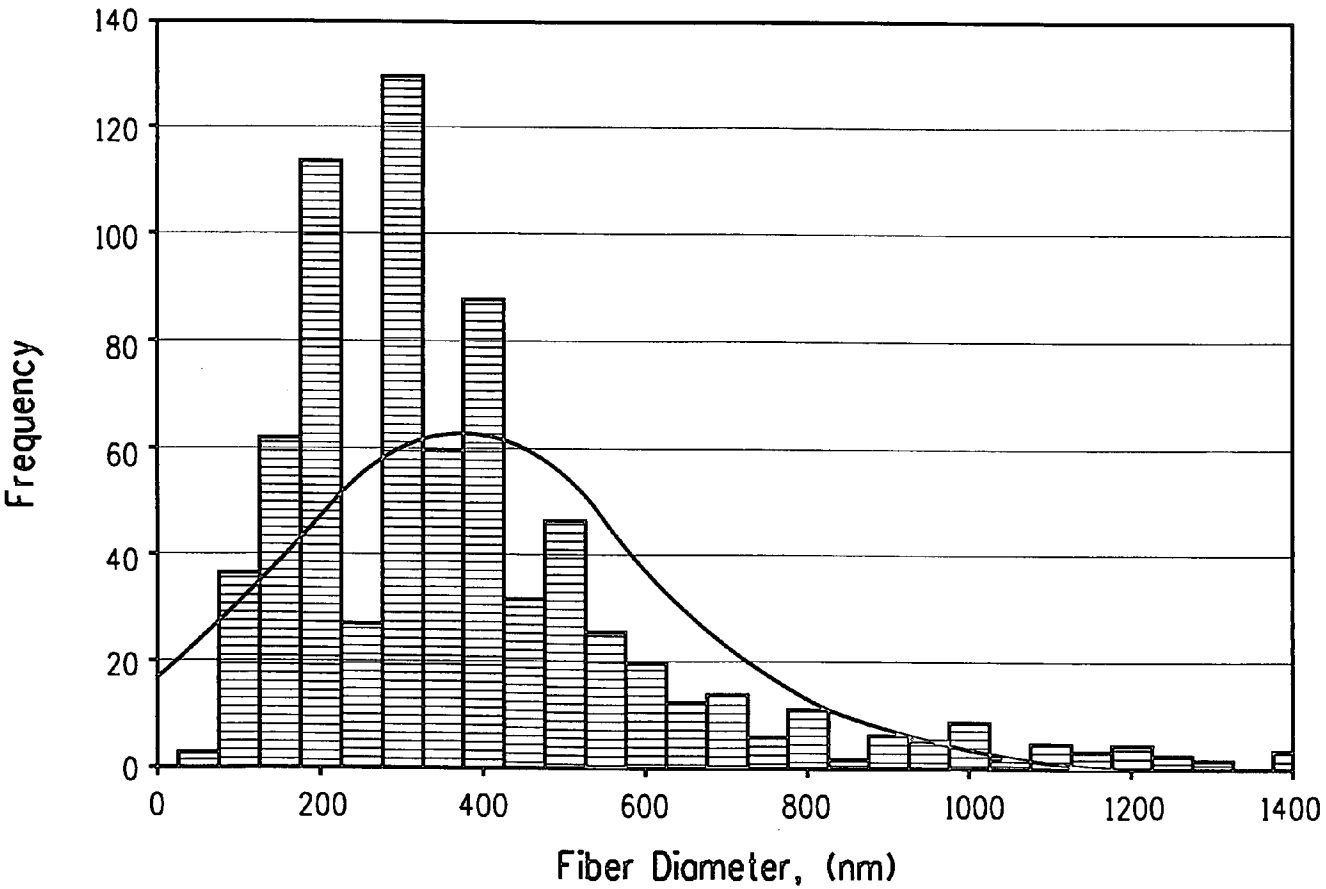
FIG. 6B is a histogram of the fiber diameters of Example 3.

Fibers were collected on a Reemay nonwoven collection screen that was held in place 15 inches away from the rotary spinning disc by stainless steel sheet metal. An SEM image of the fibers can be seen in FIG. 6A. The fiber size was measured from an image using scanning electron microscopy (SEM) and determined to be in the range of 63 nm to 1400 nm, with an average fiber diameter of about mean=378 nm and median=313 nm from the measurement of 727 fibers (FIG. 6B).

Example 4

Continuous fibers were made according to Example 1, except using a different PP homopolymer (Metocene MF650W, from Basell USA Inc., a high melt flow rate resin with very narrow molecular weight distribution, density of 0.91 g/cc at 23° C. measured using ASTM D 792, MFR=500 gram/10 min. measured using ASTM D1238). The typical shear viscosity of Metocene MF650Y PP is 9.45317 Pa-sec. at the shear rate of 10,000/sec. at 400° F. The melting point of Metocene MF650Y PP is Tm>160° C.

The distribution disc had a concave angle of 30 degrees, without a serrated discharge edge and in the absence of shear disc. The rotation speed of the distribution disc was set to a constant 11,000 rpm. The temperature of the spinning melt from melt supply tube was set to 251° C., the temperature of the distribution disc was set to 260° C. and the temperature of the blowing air was set to 220° C. No electrical field was used during this test.

Figure 7A:
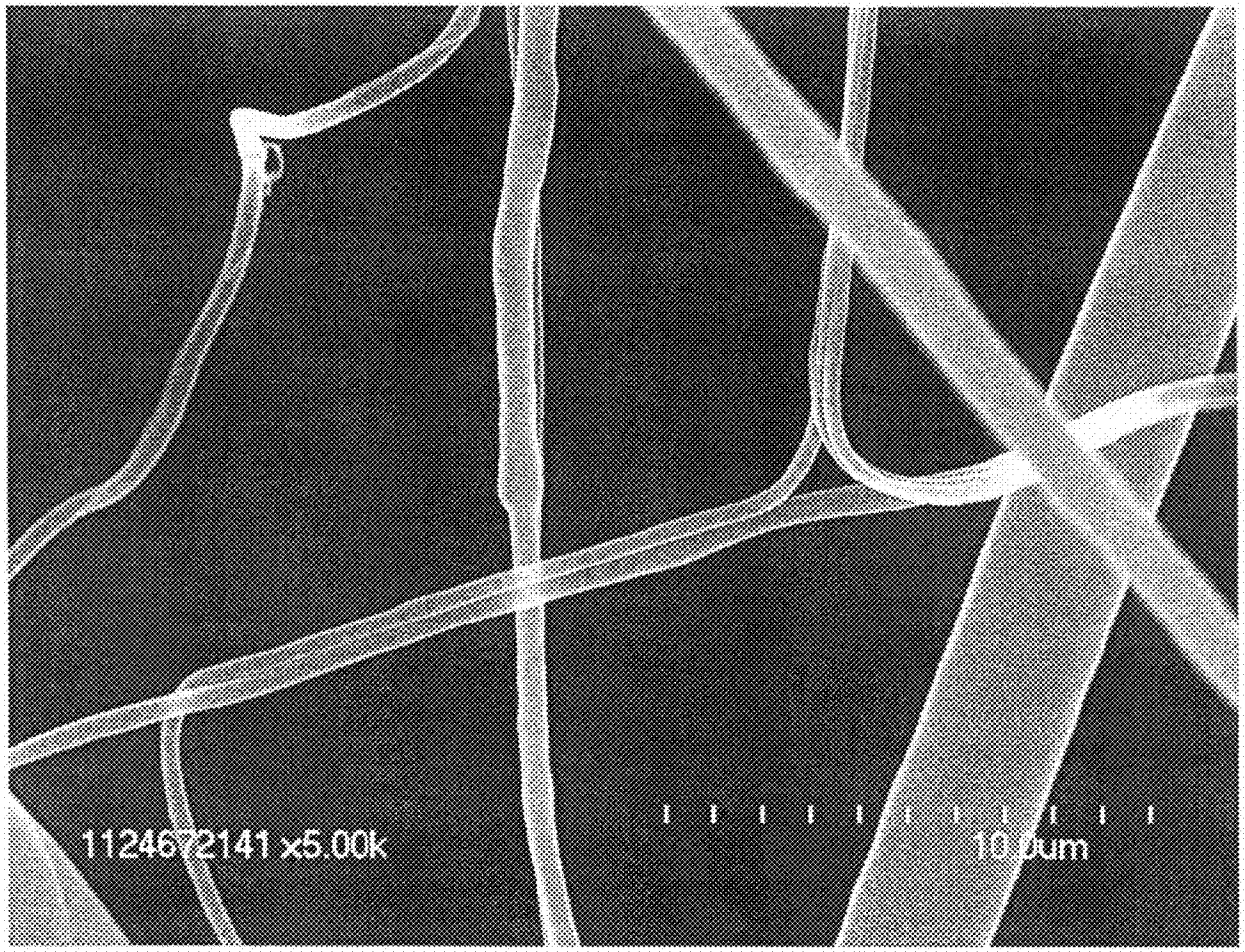
FIG. 7A is a scanning electron micrograph of polypropylene fibers from Example 4.
Figure 7B:
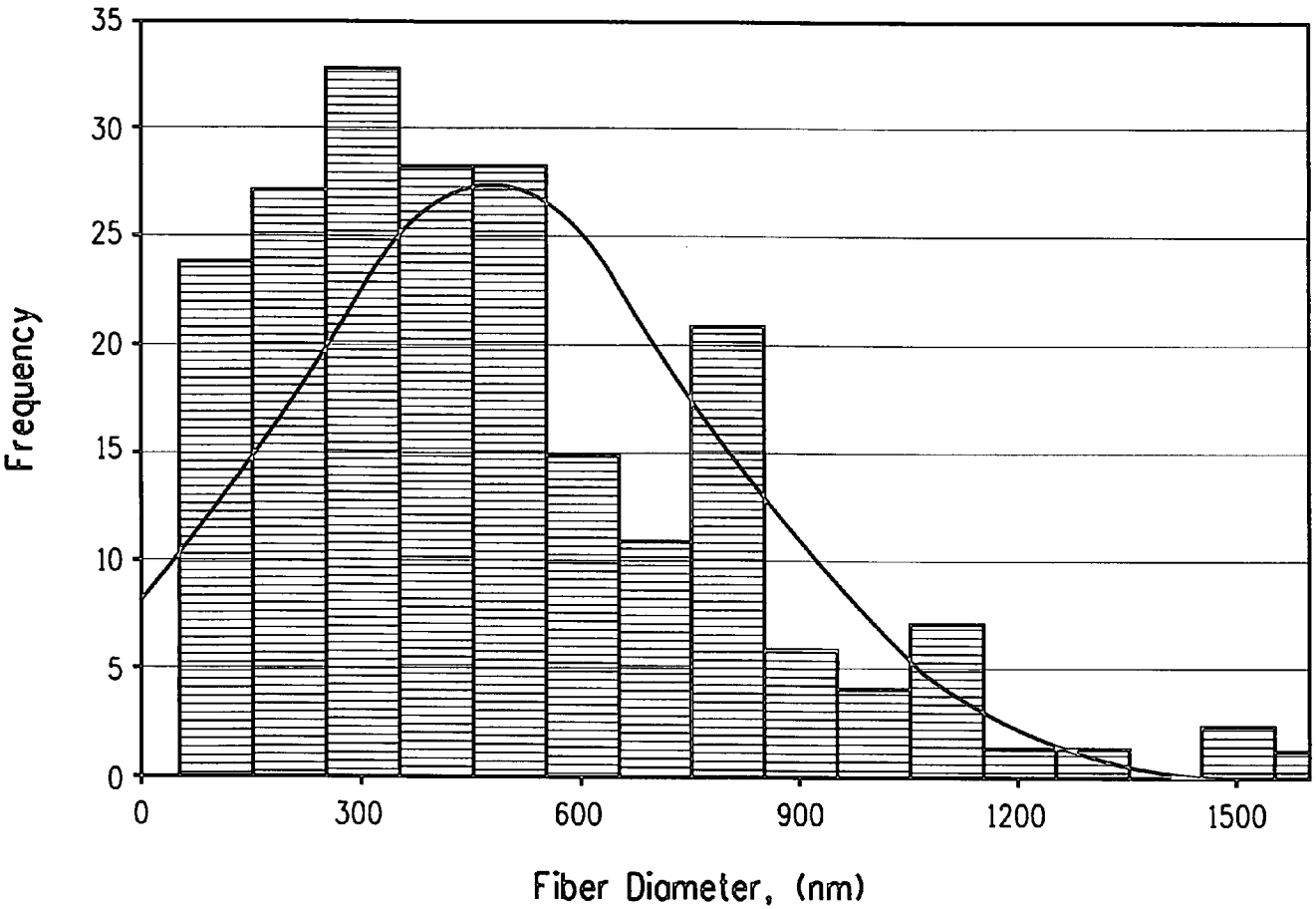
FIG. 7B is a histogram of the fiber diameters of Example 4.

Fibers were collected on a Reemay nonwoven collection screen that was held in place 15 inches away from the distribution disc by stainless steel sheet metal. An SEM image of the fibers can be seen in FIG. 7A. The fiber size was measured from an image using scanning electron microscopy (SEM) and determined to be in the range of 60 nm to 1650 nm, with an average fiber diameter of about mean=480 nm and median=400 nm from the measurement of 209 fibers (FIG. 7B).

Example 5

Continuous fibers were made according to Example 1, except using a polyethylene (LLDPE) injection molding resin (SURPASS® IFs932-R from NOVA Chemicals, Canada), a high melt index resin with very narrow molecular weight distribution. The properties of this polymer were: density of 0.932 g/cc at 23° C. measured using ASTM D 792, MI=150 gram/10 min. measured using ASTM D1238.

A PRISM extruder with a gear pump is used for deliver melt to the distribution disc through the supply tube. The pressure was set to a constant 61 psi. The gear pump speed was set to a constant 10 and this produced a melt feed rate of about 1.6 cc/min. The hot blowing air was set at a constant 30 psi. The rotary spinning disc had a concave angle of 30 degrees, with serrated discharge edge and in presence of a stationary shear disc. The rotation speed of the distribution disc was set to a constant 13,630 rpm. The temperature of the spinning melt from the melt supply tube was set to 250° C., the temperature of the rotary spinning disc was set to 220° C. and the temperature of the blowing air was set to 160° C. No electrical field was used during this test.

Figure 8A:
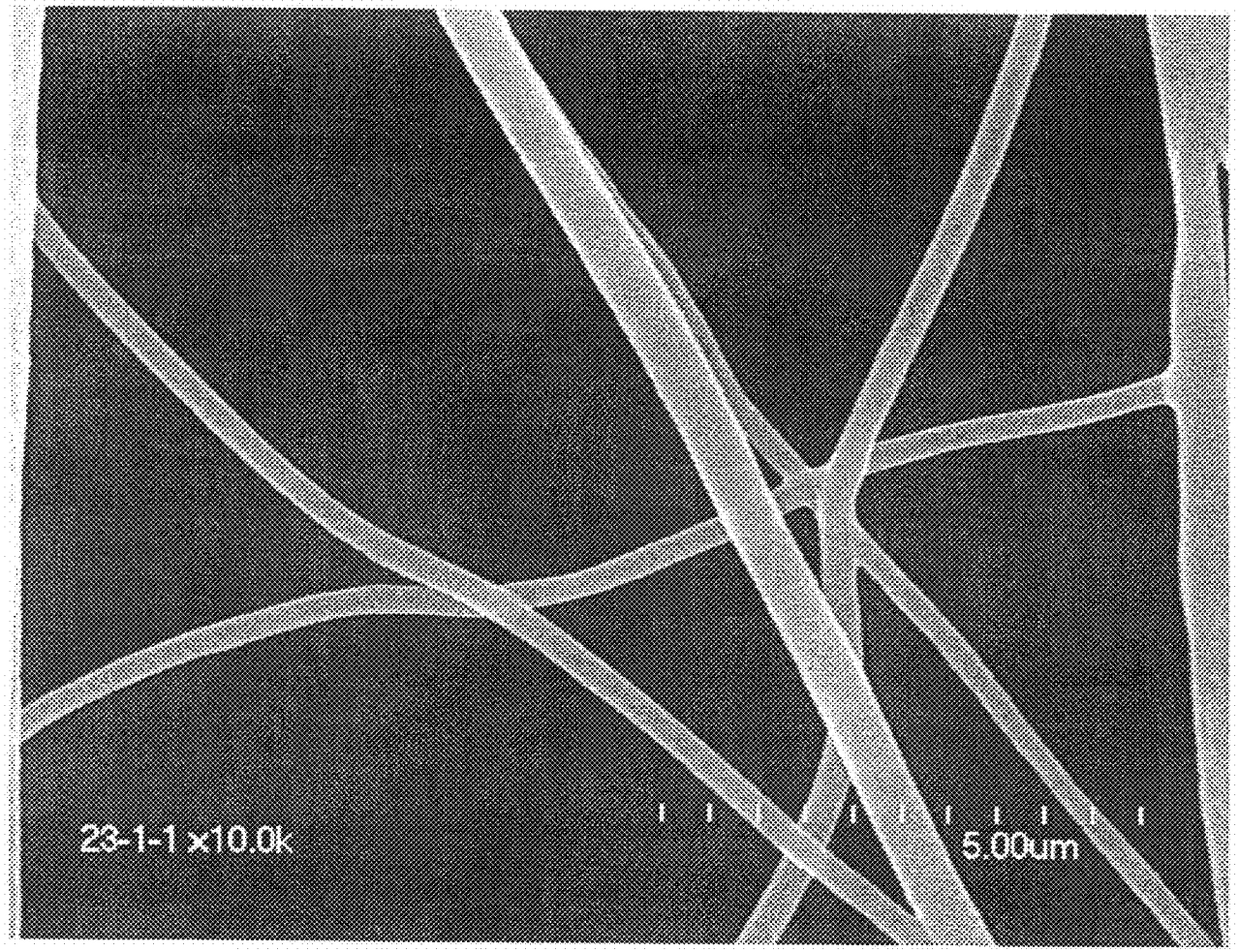
FIG. 8A is a scanning electron micrograph of polyethylene fibers from Example 5.
Figure 8B:
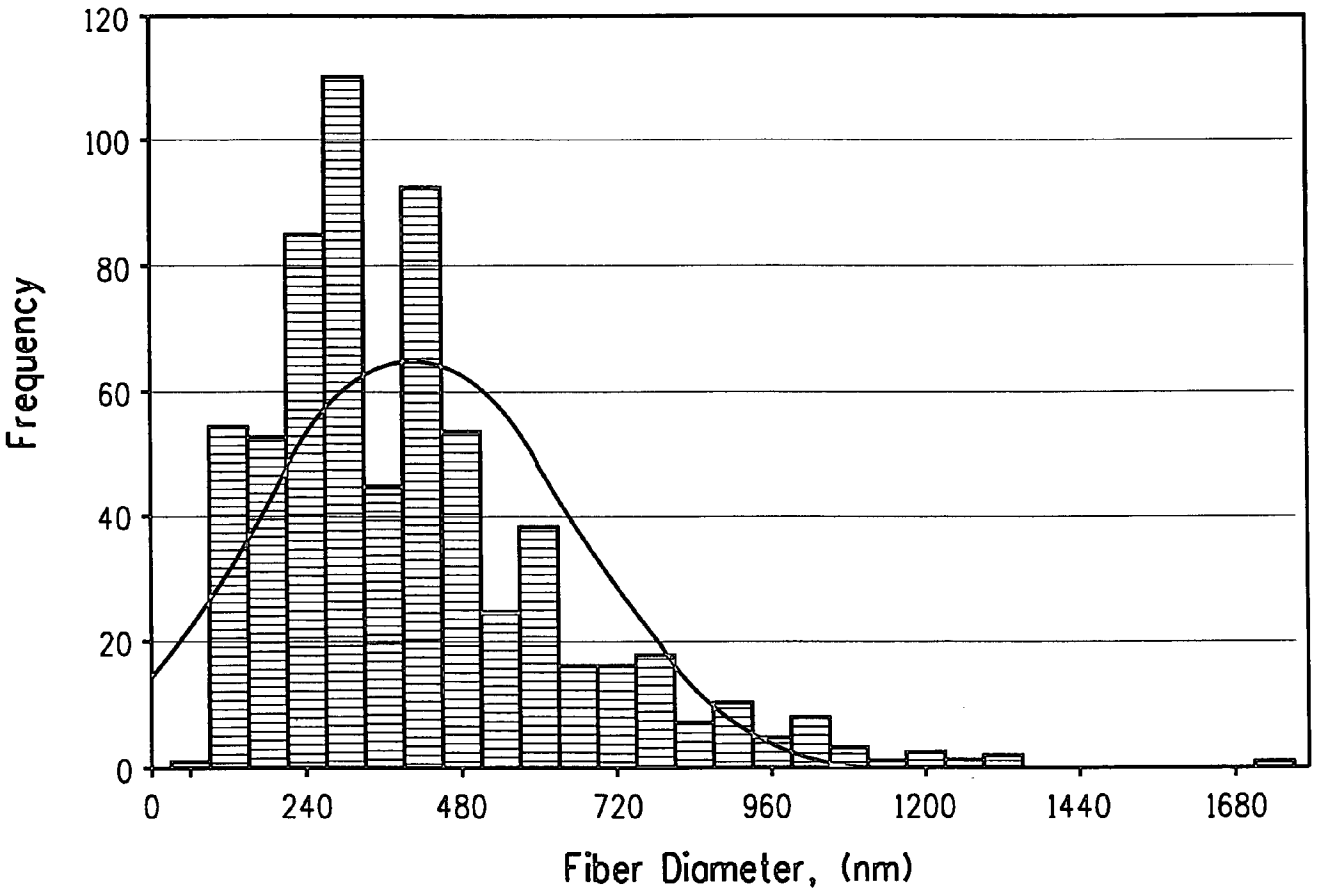
FIG. 8B is a histogram of the fiber diameters of Example 5.

Fibers were collected on a Reemay nonwoven collection screen that was held in place 15 inches away from the distribution disc by stainless steel sheet metal. An SEM image of the fibers can be seen in FIG. 8A. The fiber size was measured from an image using scanning electron microscopy (SEM) and determined to be in the range of 53 nm to 1732 nm, with an average fiber diameter of about mean=409 nm and median=357 nm from the measurement of 653 fibers (FIG. 8B).

What is claimed is:

1. A nanofiber forming process comprising the steps of:

supplying a spinning melt of at least one thermoplastic polymer to an inner spinning surface of a heated rotating distribution disc having a forward surface fiber discharge edge;

issuing the spinning melt along said inner spinning surface so as to distribute the spinning melt into a thin film and toward the forward surface fiber discharge edge; and wherein the process further comprises a discharging step that comprises discharging melt ligaments from the forward surface discharge edge and attenuating by centrifugal force the melt ligaments to produce continuous polymeric nanofibers that have mean fiber diameters of less than about 1,000 nm.

2. The process of claim 1, wherein the polymer is selected from the group consisting of polyolefins, polyesters, polyamides, polyaramids, polycarbonates, poly(meth)acrylates, polystyrene-based polymers, biopolyesters, thermotropic liquid crystal polymers, cellulose esters, thermoplastic cellulose, acrylonitrile-butadiene-styrene resins, acetals, acrylics, chlorinated polyethers, fluoropolymers, vinyl polymers, biodegradable polymers, bio-based polymers, bicomponent engineering polymers, embedded nanocomposite containing polymers, natural polymers, and copolymers and combinations thereof.

3. The process of claim 1, wherein the spinning melt has a viscosity from about 1,000 cP to about 100,000 cP.

4. The process of claim 1, wherein the spinning melt is supplied at a throughput rate from about 0.1 g/min to about 500 g/min.

5. The process of claim 1, wherein the rotational speed of the rotating distribution disc is between about 1,000 rpm and about 100,000 rpm.

6. The process of claim 1, wherein the rotating distribution disc is heated by indirect heating selected from infrared heating, induction heating or radiation heating.

7. The process of claim 1, wherein the molten polymer fibrous streams discharged from the forward surface discharge edge are directed into a hot blowing gas stream and away from the rotating distribution disc.

8. The process of claim 1, wherein the blowing gas has a temperature at or above the melting point of the polymer.

9. The process of claim 1, which forms nanofibers having a mean fiber diameter less than about 500 nm.

10. The process of claim 1, further comprising cooling the nanofibers with a cooling gas having a temperature below the melting point of the polymer.

11. The process of claim 1, further comprising collecting the fibers onto a collector to form a fibrous web.

12. The process of claim 11, further comprising applying a vacuum through the collector to pull the fibers onto the collector to form a fibrous web.

13. The process of claim 11, wherein a voltage potential is maintained between the rotating distribution disc and the collector.

14. The process of claim 13, wherein the voltage potential is maintained between the rotating distribution disc and an electrode positioned between the rotating distribution disc and the collector.

15. The process of claim 13, wherein the voltage potential is maintained between the collector and an electrode positioned between the rotating distribution disc and the collector.

16. The process of claim 13, wherein the voltage potential is between about 1 kV to about 150 kV.

* * * * *